United States Patent [19]

Wallin

[11] 4,417,882

[45] Nov. 29, 1983

[54] METHOD AND APPARATUS FOR ERECTING A CARTON TRAY

[75] Inventor: Kay Wallin, Halmstad, Sweden

[73] Assignee: Sprinter System AB, Sweden

[21] Appl. No.: 199,674

[22] Filed: Oct. 21, 1980

[30] Foreign Application Priority Data

Oct. 30, 1979 [SE] Sweden ..... 7908988

[51] Int. Cl.[3] ..... B31B 1/46

[52] U.S. Cl. ..... 493/174; 493/167

[58] Field of Search ..... 493/167, 168, 174, 140, 493/169

[56] References Cited

U.S. PATENT DOCUMENTS 2,925,758 2/1960 Beetz ..... 493/167 X
2,930,294 3/1960 Ritscher .
3,191,508 6/1965 Beamish ..... 493/167 X
3,618,481 11/1971 Odenhagen ..... 493/167
4,295,839 10/1981 Baker et al. ..... 493/174 X

FOREIGN PATENT DOCUMENTS 22139 11/1979 European Pat. Off. ..... 493/174

*Primary Examiner*—James F. Coan
*Attorney, Agent, or Firm*—Ostrolenk, Faber, Gerb & Soffen

[57] ABSTRACT

In the erection of a tray having edge flaps with end flaps which are to be fastened together for forming a rim of edge flaps intended for receiving a lid, the erection is performed in two separate tools. In the first tool only the one pair of opposing edge flaps are folded out, whereafter their end flaps are folded up and attached to the outside of the second pair of end flaps. The partially erected tray is then ejected from the underside of the forming chamber and transferred to a second tool where all edge flaps are subjected to being folded downwards.

10 Claims, 15 Drawing Figures

Figure 1:
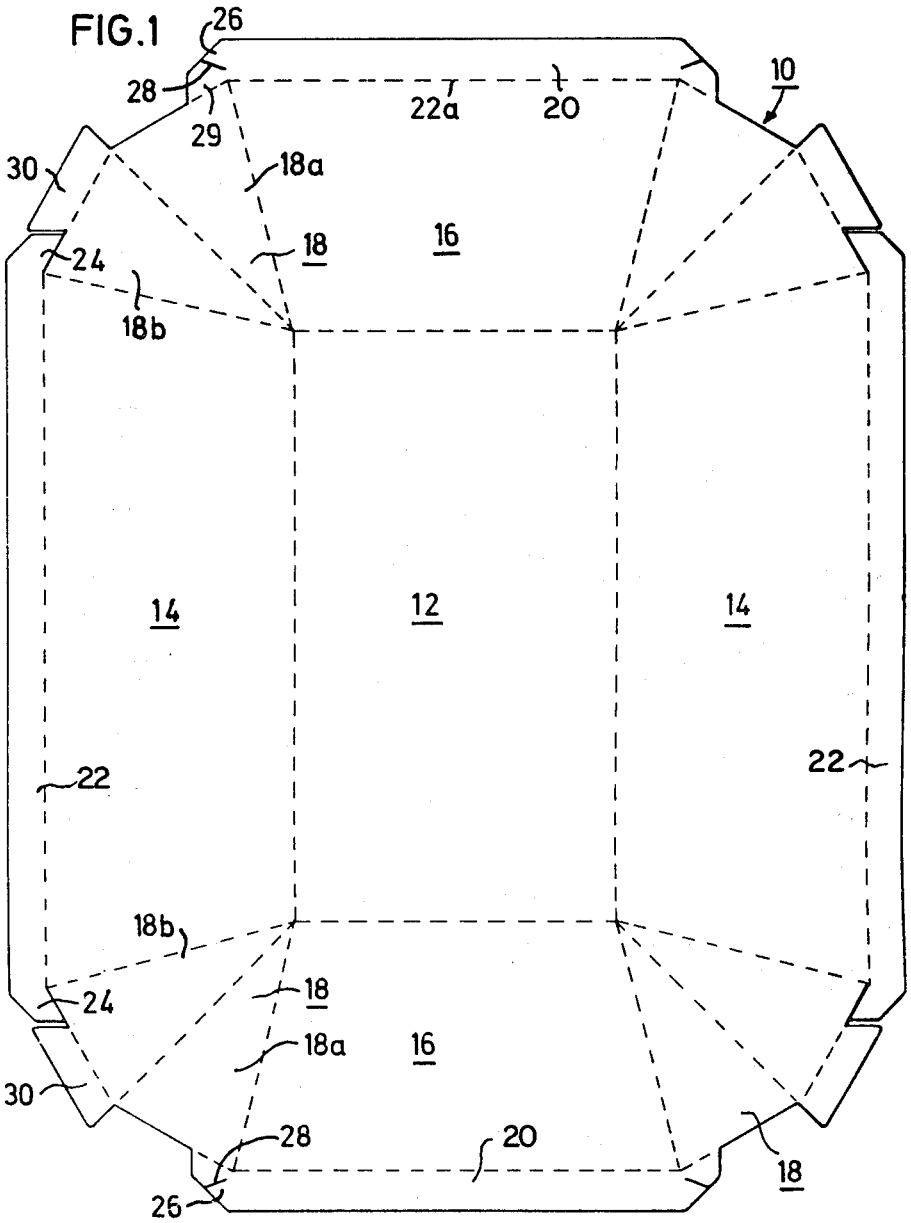

FIG. 10A
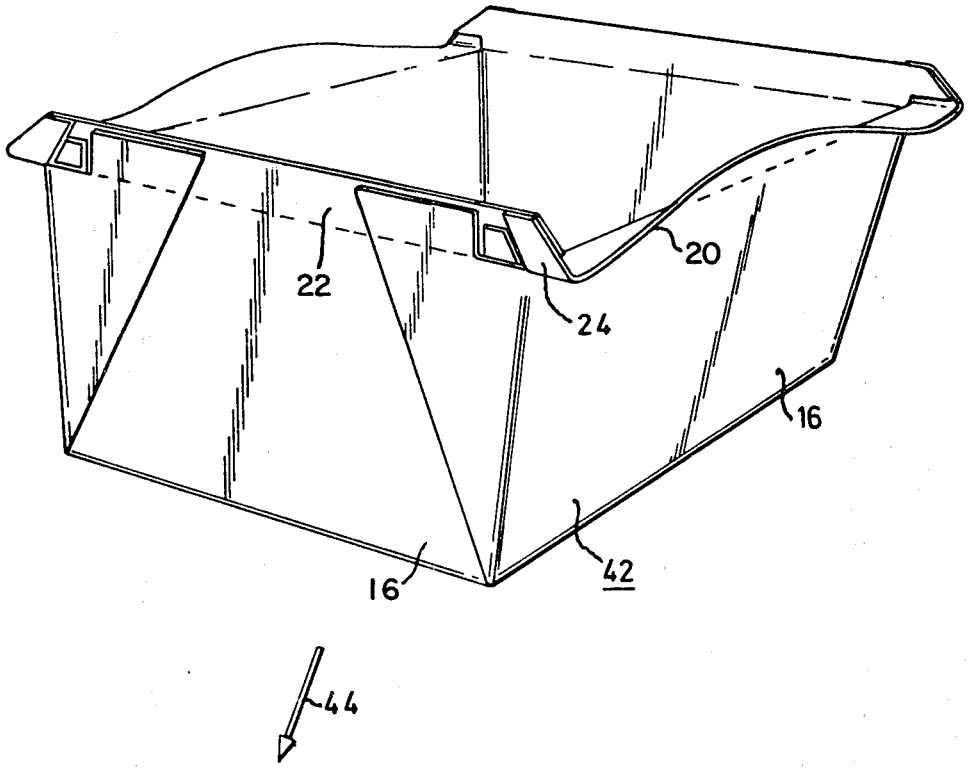
FIG. 10B
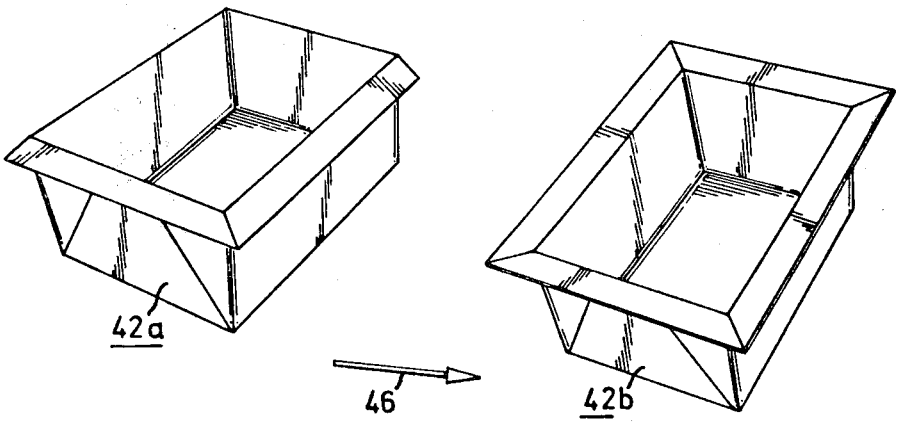
FIG. 10C

METHOD AND APPARATUS FOR ERECTING A CARTON TRAY

The present invention relates to a method of erecting carton trays of the kind which have a bottom and side walls of which at least three side walls are provided with outwardly folded edge flaps for receiving a lid which is intended to be attached by a binding agent on the rim formed by the edge flaps. In the case where only three sides have edge flaps, the fourth side is extended with a lid which is hingedly connected to the side wall and can be folded down and attached to the edge flaps. However, the lid is usually separate, and is then placed on a closed rim of edge flaps.

The carton blank for such a tray of the kind in question has intermediate portions which can be folded double between the ends of the side walls, and when erecting the tray these portions are folded double to form so-called webs and turned in towards one side wall at the respective corner of the tray and are fixed by the double-folded portion having edge flaps which are fastened together by a binding agent.

The binding agent usually consists of a thermically sealable coating on the carton blank. The places which are to be fastened together are heated up by hot air, and thereafter these places are subjected to a pressure by pressure means such as clamping jaws, clamping rollers or the like.

For the type of tray in question, the ends of the edge flaps are formed as end flaps, and during erection they are laid one above the other and fastened to the respective corner by heat and pressure.

To erect the tray, the whole erection operation to form a finished tray has been so far performed using only one tool. This is constituted so that a plunger presses the blank down into a forming chamber while folding the corner portions double, and erecting the side walls as well as folding out all the edge flaps to a plane parallel to the bottom of the tray and engaging against a die. The end flaps at the corners will thus assume a position overlapping each other. The edge flaps of the double-folded end portions or webs are welded together, and the heated end flaps are also subjected to pressure from movable clamping jaws for fixing the end flaps to each other. Thereafter an ejector is operated which thrusts up the finished tray from the forming chamber. The edge flaps will then spring back again more or less and can in certain cases return to an obliquely upwardly directed position which forms an angle of 20°–30° to the bottom of the tray.

The known method of erecting the tray in question involves a relatively complicated and thus expensive tool. Four movable clamping jaws are required, inter alia, to exert pressure on the end flaps at the corners, and a corresponding cam for controlling the movement of the jaws.

Furthermore, there is an ejector with associated cam control.

Another disadvantage is that the tray cannot be ejected from the underside of the forming chamber, which signifies that one must wait until the finished tray has been pushed up and out from the forming chamber before putting in a new blank.

The object of the present invention is therefore to provide a method of erecting this kind of tray such as to enable a simplification of the mechanical means for the erection, and simultaneously enable a higher rate of manufacture.

This is achieved by a method which, according to the invention, has the characterizing features disclosed in the following claims.

In the method according to the invention, the erection of the tray is carried out using two separate tools, such of which is simple their combined cost being lower than the cost of one of the tools known so far in which the entire erection of the tray is carried out in one tool. Furthermore, the first phase of erection is executed in a way such that the partially erected tray can be thrust out at the underside of the forming chamber and thereby immediately make way for a new blank. A higher production capacity is hereby enabled since the second tool works simultaneously for finalizing the erection of the tray.

No cam-controlled clamping jaws are required in the first tool. Furthermore, a cam-controlled ejector is no longer required.

In the second tool, all the edge flaps can be turned down into a severely downwardly directed position without any risk of rupturing. The angle of turning down is so great that after taking out the finished tray from the tool, the edge flaps will once again spring back in a direction towards a position which is substantially closer to a plane parallel to the bottom of the tray than what is possible with the method known so far. Practical trials have shown that a pair of the edge flaps will lie approximately parallel to the bottom of the tray, while the second pair has a slightly downwardly directed position, whereby the edge flaps assume positions which are suitable for receiving a lid for welding it to the rim formed by the edge flaps.

These and other details and advantages distinguishing the invention will be explained in more detail with reference to the appended drawings, which illustrate different operations in erecting a tray in the manner proposed by the invention.

Figure 2:
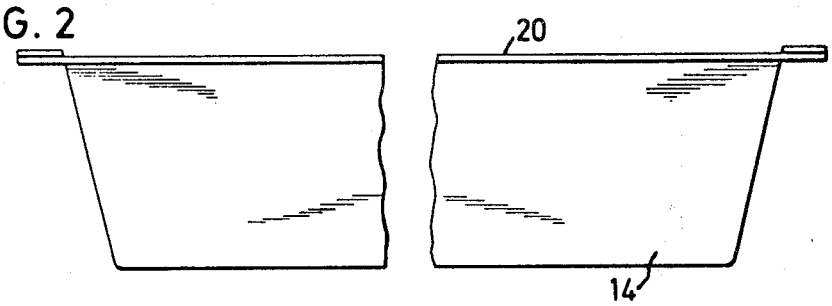
Figure 3:
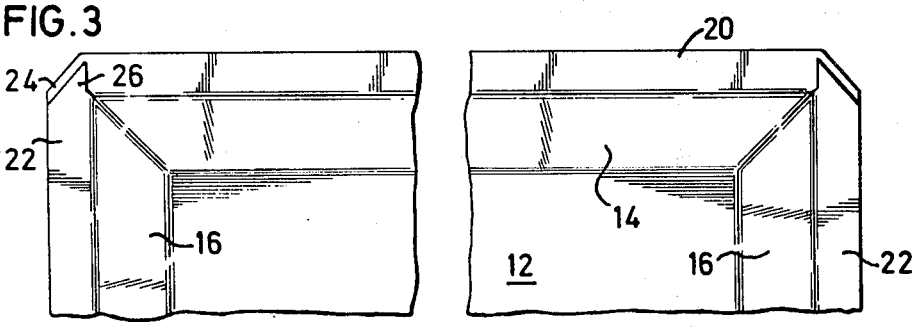
Figure 4:
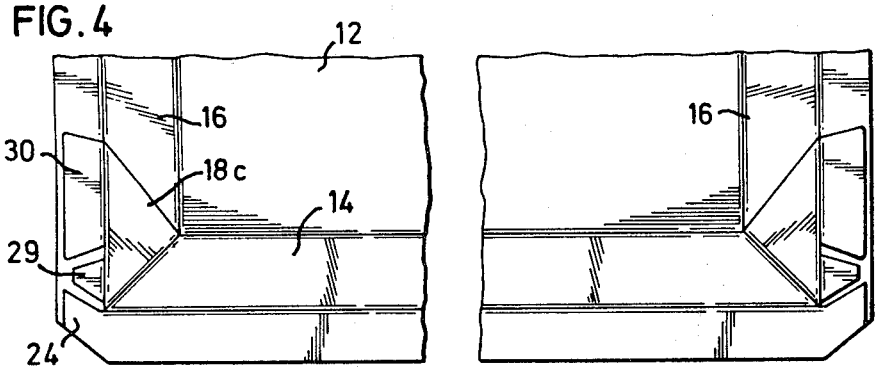
Figure 5:
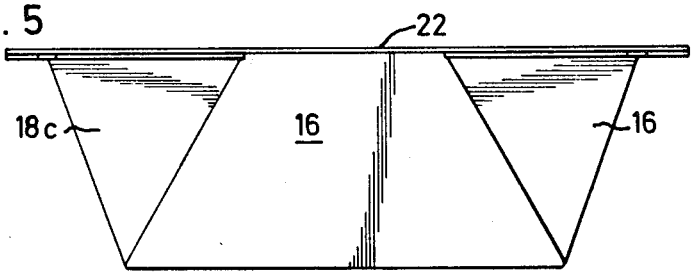
Figure 7:
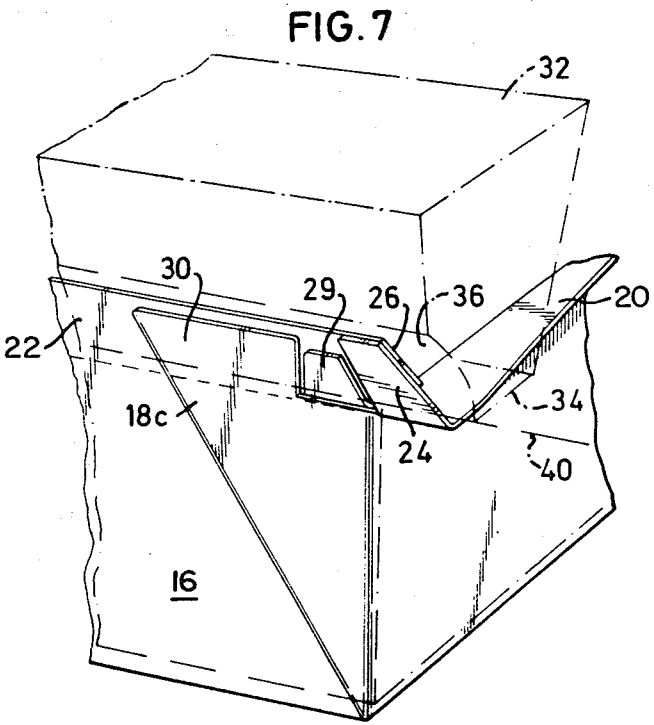
Figure 6:
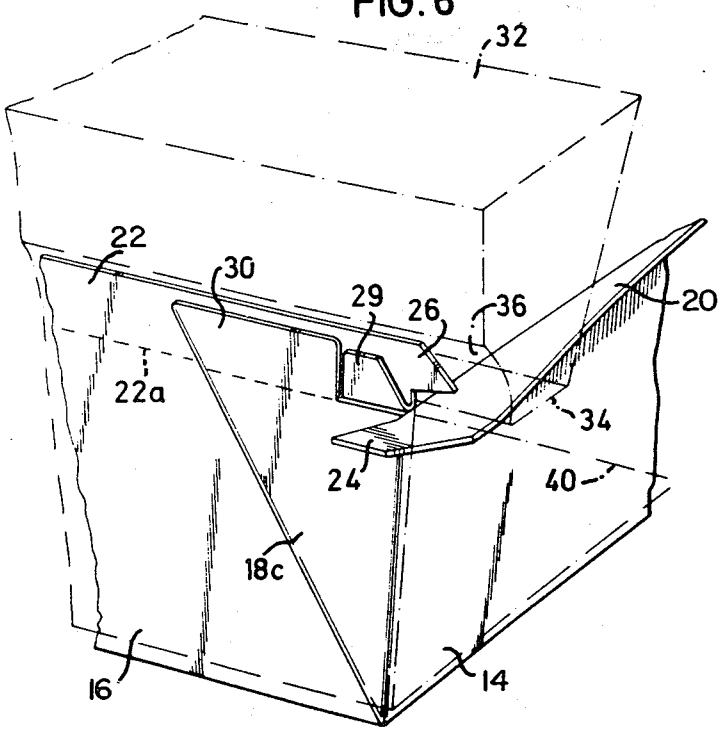
Figure 8:
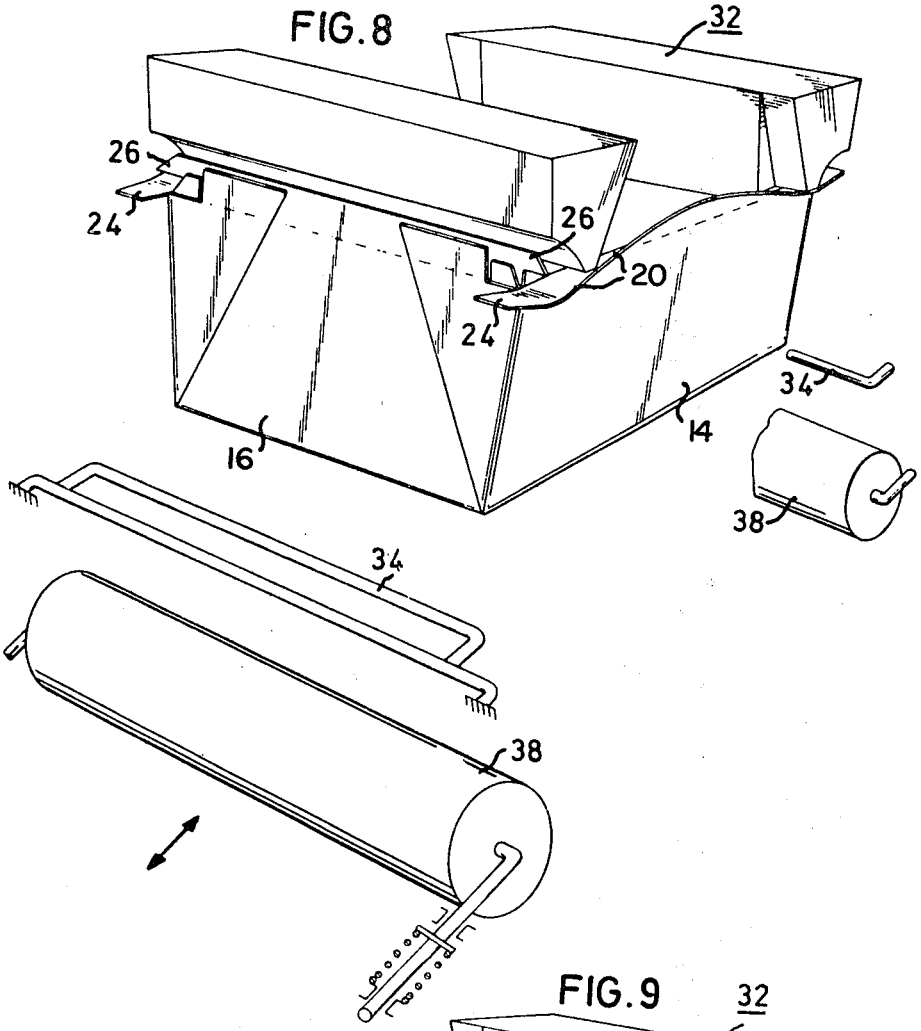
Figure 9:
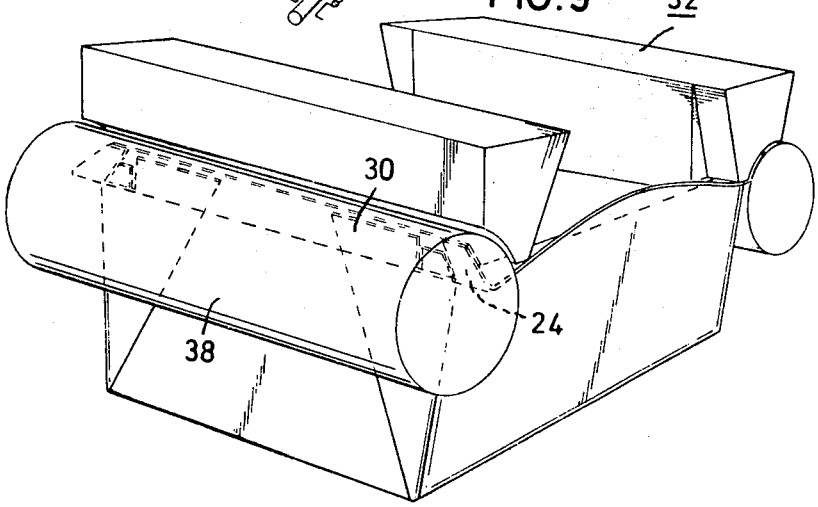
Figure 11:
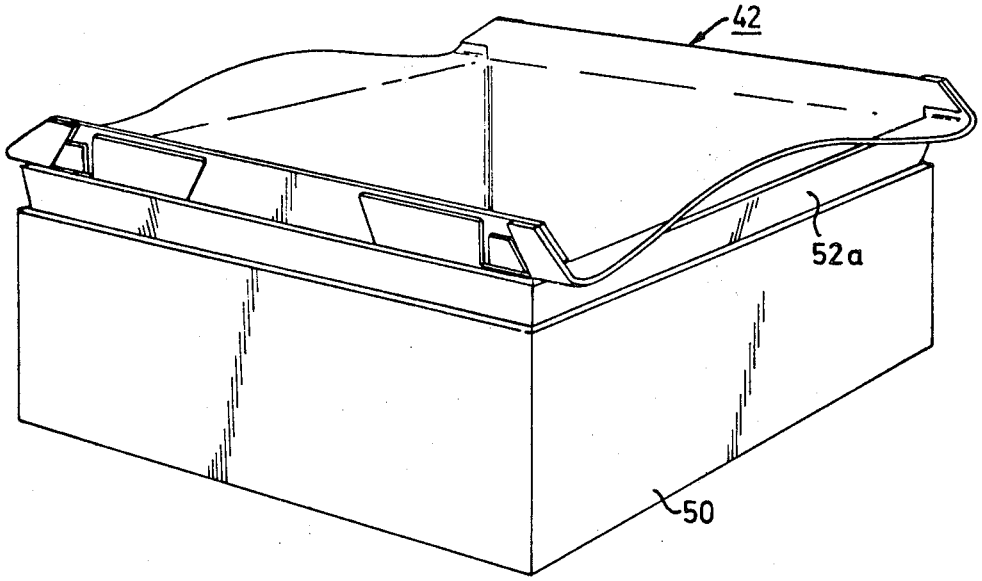
Figure 12:
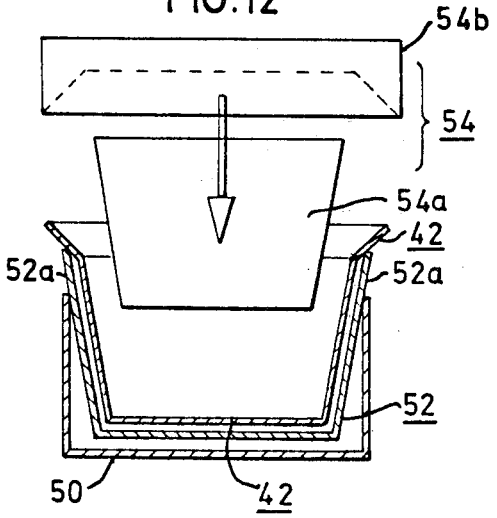
Figure 13:
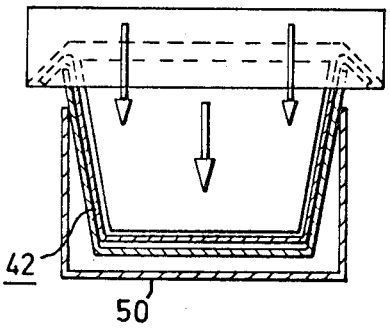

FIG. 1 illustrates a blank for erection into a tray according to the inventive method, FIG. 2 is a side view of the tray, FIG. 3 is a fragmentary view of the tray from above, FIG. 4 is a fragmentary view of the tray from below, FIG. 5 is an end view of the tray, FIG. 6 is a schematic perspective depiction of one corner portion of the tray during erection in the first tool, FIG. 7 is a schematic perspective depiction showing the folding up of the end flaps during erection in the first tool, FIG. 8 is a schematic perspective depiction to illustrate how the plunger in the first tool affects the partially erected tray and how this coacts with pressure means in the forming chamber, FIG. 9 schematically illustrates the pressure rollers in FIG. 8 in a position for engaging against the tray, FIGS. 10A–10C illustrate schematically how the partially erected tray produced in the first tool is treated in the second tool for folding down the edge flaps, and finally the finished tray, FIG. 11 is a schematic depiction of the partially erected tray lowered into the second tool with edge strips for folding the edge flaps, FIG. 12 is a schematic section through the second tool before the plunger goes down, and FIG. 13 illustrates the plunger in the bottom position with the edge flaps of the tray severely folded down.

The blank 10 in FIG. 1 is essentially of a conventional embodiment having a bottom 12, two longitudinal side walls 14, two transverse end walls 16 and edge portions 18 which can be folded double between the ends of the walls.

The side walls have edge flaps 22 and the end walls have edge flaps 20. Since all the corners are equal, only the upper left corner will be described, which is also shown in FIGS. 6 and 7.

The edge flaps 22 are extended at the ends with free end tabs 24. The edge flaps 20 in their turn have their ends extended with end tabs 26, obtained in the shown example by means of a small slit 28 while leaving a small tab 29 on one corner area 18*a*, whereas the other corner area 18*b* has a somewhat larger edge flap 30.

Erection of the blank is done with the aid of a plunger 32 in a first tool which has a forming chamber (not shown) corresponding to the plunger and with no bottom so that the erected tray can be fed out at the bottom of the forming chamber.

Erection of the side walls 14 and end walls 16, as well as the double-folding of the corner portions 18 into triangular locking portions or webs 18*c*, with folding of the latter against the end walls 14, takes place in a manner known per se and is therefore not described.

During operation when the blank is pressed into the forming chamber, the blank is formed to a conical tray with sloping side walls and end walls, the side walls and end walls of the tray engaging against the sides of the plunger. As is apparent inter alia from FIG. 6, the plunger 32 is made so that it turns out the edge flaps 20 with tab 24, and thereby the tabs 24 to a plane substantially parallel to the bottom of the tray, while the edge flaps 22 are allowed to remain unaffected in a position substantially in a plane with the end walls 16, as is illustrated in FIGS. 6 and 8.

With the continued movement of the plunger 32, the tabs 24 are met by an abutment wire 34 (FIG. 8) which the plunger can pass freely. The tabs 24 are thus folded up against the outside of the tabs 26, as shown in FIG. 7.

The blank is coated in a manner known per se with a heat-sealable coating which is conventionally melted by hot air at the places where it is desired to weld parts of the blank together. So-called hot-melt can also be used for joining.

On its outside facing towards the respective end 16 wall of the tray, the plunger 32 forms a die or pad 36 for the edge flaps 22,30 and tab 29 and for the tabs 26 when the tabs 24 are to be pressed home against the tabs 26.

With the continued downward movement of the plunger, a pair of spring-loaded pressure rollers 38 come into engagement against the tabs 24 and against the edge flaps 22,30 and 29 for fixing them. Clamping the tabs 24 against the tabs 26 thus takes place with extremely simple mechanical aids which are considerably cheaper than previously known movable clamping jaws and their associated cam controls.

Folding up the tab 24 takes place essentially about a line 40 which substantially coincides with the crease line 22*a* of the edge flap 22. This signifies that the edge flap 22 can be folded out and down together with the tabs 24 and the tabs 26, without there being any risk of rupture due to excessive strain on the carton material. The partially erected tray is finally pressed out under the first tool.

Feeding of the blank and the erected tray down through the forming chamber by the plunger can take place without interruption, which enables high rates of manufacture. No cam controls for movable clamping jaws and special ejectors with associated cam control need be used.

In the partially erected tray 42 in FIG. 10A only the edge portions of the end flaps 20 are folded down, while the middle portion of the flaps 20 remain resiliently swung upwards. The edge flaps 22 are obliquely upstanding, substantially in a plane with the sloping end walls 16.

The arrow 44 in FIG. 10B indicates that the tray 42 is moved to the second tool where the tray 42*a* gets its edge flaps heavily downwardly folded. The arrow 46 in FIG. 10C indicates that the tray 42*a* is taken out from the second tool, whereafter the edge flaps spring back as indicated by the tray 42*c*.

The second tool 50 is illustrated schematically in FIGS. 12 and 13 and comprises a forming chamber 52 for receiving the tray, which is pressed down with the aid of a bifurcated plunger 54.

The forming chamber has upstanding edges 52*a* which function as folding bars over which the edge flaps of the tray can be folded down to the obliquely downwardly directed position illustrated in FIG. 13.

The bottom portion 54*a* of the plunger first presses down the tray into position in the forming chamber. The upper portion 54*b* is then pressed down against the action of springs in a known way, for folding all the edge flaps over the edges 52*a* into a heavily downwardly directed position.

As is apparent from the above, both the first tool and the second tool have extremely simple construction, which results in relatively low tool costs. These will be lower than for a tool of the known embodiment, where the entire erection is performed in a single tool. Since both the tools can operate simultaneously and independently of each other, there is enabled a high production capacity which can be greater than what is possible with a single tool of the known embodiment.

What I claim is:

1. A method of erecting a carton tray, the side and end walls of which are provided with outwardly turned edge flaps, at least on three sides and preferably on all four sides, for receiving a lid intended for attaching by means of a binding agent on the rim formed by the edge flaps, the end portions of the edge flaps being extended with end flaps situated one on top of the other and fastened by a binding agent for connecting the edge flaps to each other the erection being performed in two separate phases in two separate tools, the erection in the first tool being performed by means of a plunger which presses the carton blank down into a forming chamber to form a partially ready-shaped tray with the side walls and end walls thereof erected in their final position, characterized in that joining of the two end flaps in the respective corner of the tray is performed by only one pair of opposing edge flaps being folded down by the plunger together with their associated end flaps to a position substantially in a plane parallel to the bottom of the tray, whereafter these end flaps are folded up in a subsequent operation and are attached to the outside of the end flaps of the second pair of edge flaps, which together with their end flaps remain substantially in the same plane as the associated side wall of the tray, and that the partially erected tray is subsequently ejected out from the underside of the forming chamber, whereupon this partially erected tray is transferred to the second tool where all edge flaps are folded down to their first position over the edge of folding bars or the like to an oblique downward direction position, whereafter the tray is ejected form the forming chamber of the second tool as the edge flaps resiliently return to a position for receiving the lid.

2. The method of claim 1 wherein said forming chamber has an inner peripheral surface conforming substantially to the tray which is to be formed and said plunger has an outer peripheral surface which substantially conforms to the inner surface of the tray which is to be formed.

3. The method of claim 2, wherein resilient pressure is exerted on the carton as it is forced downwardly into the chamber.

4. A tool for forming a carton blank into a tray with edge flaps formed with end flaps at their ends and comprising a plunger intended for pressing the blank down into a forming chamber while erecting the side walls and end walls of the tray to a final position, characterized in that the plunger is adapted for only folding out one pair of opposing edge flaps of the tray while the other pair of edge flaps are left substantially upstanding, and that means are arranged in the forming chamber for folding the end flaps of the outwardly folded edge flaps and pressure-fastening these end flaps with the coaction of a binding agent against the outside of the end flaps of the substantially upstanding edge flaps, subsequent to which the plunger is adapted for discharging the partially erected tray at the underside of the forming chamber.

5. The tool of claim 4, wherein said forming chamber has an inner peripheral surface conforming substantially to the tray which is to be formed and said plunger has an outer peripheral surface which substantially conforms to the inner surface of the tray which is to be formed.

6. The tool of claim 5, wherein resilient pressure is exerted on the carton as it is forced downwardly into the chamber.

7. The tool of claim 6, wherein the means for applying said resilient pressure comprises a roller on opposite sides of the carton facilitating entry of the carton into the chamber.

8. The tool of claim 6, wherein a second tool is provided comprising a plunger which engages the upper end of the carton and is moved downwardly to effect such engagement and wherein the lower surface of the plunger is greater in extent than the opening of the carton, whereby the flaps are bent downwardly.

9. The tool of claim 8, wherein said plunger is preformed on its underside to provide a downwardly directed peripheral section at the area of the plunger which engages the flaps of the carton, thereby folding the flaps downwardly as the plunger is moved downwardly.

10. The tool of claim 9, wherein the resilience of the flaps after they are formed causes the flaps to extend horizontally parallel to the bottom wall of the carton after the carton and second plunger are separated.

* * * * *